US006938984B2

(12) United States Patent
German et al.

(10) Patent No.: US 6,938,984 B2
(45) Date of Patent: Sep. 6, 2005

(54) CUSTOM COLOR INKJET PRINTING SYSTEM

(75) Inventors: Kristine A. German, Webster, NY (US); George A. Gibson, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 101 days.

(21) Appl. No.: 10/342,542

(22) Filed: Jan. 15, 2003

(65) Prior Publication Data

US 2004/0135859 A1 Jul. 15, 2004

(51) Int. Cl.[7] ..... B41J 2/21; B41J 2/175
(52) U.S. Cl. ..... 347/43; 347/86
(58) Field of Search ..... 347/43, 15, 85–87, 347/19

(56) References Cited

U.S. PATENT DOCUMENTS 5,646,656 A * 7/1997 Leonhardt et al. ..... 347/43
5,897,239 A * 4/1999 Caruthers et al. ..... 399/54
6,052,195 A * 4/2000 Mestha et al. ..... 356/425
6,097,405 A * 8/2000 Lo et al. ..... 347/6

FOREIGN PATENT DOCUMENTS

EP 0 925 936 6/1999

OTHER PUBLICATIONS

EPO European Search Report, Application No. EP 04 00 0658, Completed Apr. 15, 2004, Munich.

* cited by examiner

*Primary Examiner*—Thinh Nguyen
(74) *Attorney, Agent, or Firm*—Fay, Sharpe, Fagan, Minnich & McKee, LLP

(57) ABSTRACT

An inkjet printing system for printing custom colors is provided. An ink mixing station is also provided. The printing system includes multiple ink channels, an ink cartridge sensor for each channel, and a controller. A method for printing custom colors in a printing system with multiple ink cartridges is provided. In another embodiment, the printing system includes an in situ mixed ink channel for receiving two or more ink supply dispensers and a controller. The in situ mixed ink channel includes an supply dispenser sensor and supply valve member for each supply dispenser, a mixing reservoir, a pump motor, and a print head. A method for printing custom colors using an in situ mixed ink channel is provided. The station includes an in situ mixed ink channel and a controller. A method for mixing custom color inks and filling inkjet ink containers in the station is provided.

23 Claims, 5 Drawing Sheets

CUSTOM COLOR INKJET PRINTING SYSTEM

BACKGROUND OF INVENTION

The invention relates to printing with custom colors in an inkjet printing system. It finds particular application in conjunction with incorporating machine-readable color ink supply tanks, mixing inks from multiple ink supply tanks to create custom colors, and printing with custom colors in an inkjet printing system and will be described with particular reference thereto. However, it is to be appreciated that the invention is also amenable to other applications.

Known methods and apparatus for mixing colorants to achieve a desired target color in pigment-based and dye-based applications involve human interaction, namely determining if the mixed colorants match the target color by visual inspection. For example, an experienced attendant of a paint mixing machine in a home improvement store will begin with a base color and add one or more other colors to achieve a customer's desired color. The attendant may refer to a predetermined paint mixing guide to determine which colors and how much of each color to add to the base color before beginning the mixing process. Alternatively, the attendant may access color formulations stored in a memory of a computer or similar device. After the paint is thoroughly mixed, the attendant will visually inspect the resulting color and confirm it matches the desired color. Alternatively reflectance spectra can be obtained using a free standing spectrophotometer and a "recipe" for mixing the desired color. Again the attendant will mix the color and confirm the match.

More human interaction is required in the case of colors that have faded or otherwise been transformed, e.g., due to environmental exposure such as solar radiation or a saltwater environment. In these cases, although the identity and proportions of colorants comprising the original color designation may be known, the target color that must be matched is actually a variation (usually a lighter shade) of the original color. In general, achieving the target color in these cases requires repeated mixing and visual inspection steps, because there is no guide that can be consulted. Here the spectrophotometric approach is the only tenable guide except for visual matching by the attendant.

Other areas in which color mixing is carried out on a trial and error basis with visual inspection include offset printing, wallpapers, fabric coloring and automobile painting, among others. In offset printing, a printer seeking to match a special color relies on industry standard color matching systems to match the special color. Common systems include those published by Pantone and Sun Printing Inks.

It is well known that conventional inkjet printing processes can be adapted to produce multicolor images. For example, an input image may be divided into a series of color separated images corresponding to the primary colors in the input image. Each color separated image is printed with a complimentary ink marking material in a primary color or a colorant which is the subtractive compliment of the color separated image, with each printed color separated image subsequently superimposed, in registration, on one another to produce a multicolor image output. Thus, a multicolor image is generated from patterns of different primary colors or their subtractive compliments that are blended by the eye to create a visual perception of a color image.

This procedure of separating and superimposing color images produces so-called "process color" images, wherein each color separated image comprises an arrangement of picture elements, or pixels, corresponding to a spot to be developed with ink marking material of a particular color. The multicolor image is a mosaic of different color pixels, wherein the color separations are laid down in the form of halftone dots. In halftone image processing, the dot sizes and/or spatial densities of each of the color components making up the multicolor image can be altered to produce a large variation of color hues and shades. For example, lighter tints can be produced by reducing the dot size or spatial densities such that a greater amount of white from the page surface remains uncovered to reflect light to the eye. Likewise, darker shades can be produced by increasing the dot size or spatial densities. This method of generating process color images by overlapping halftones of different colors corresponding to the primary colors or their subtractive equivalents is well known in the art and will not be further described herein. The range of colors that can be produced by this process is determined by the number of primary colors that are used and the colors of those primaries. Generally a four-color process is employed using cyan, magenta, yellow and black primaries. Other systems using more primary inks are also known and are referred to by names such as "hyper color", "HiFi Color," IndiColor™ and the like. These systems allow a wider range or gamut of colors to be produced.

With the capabilities of digital printing moving into multicolor imaging, advances have also been directed to the creation of so-called "highlight color" images, wherein independent, differently colored, monochrome images are created on a single output copy sheet, preferably in a single processing cycle. Likewise, "spot color" and/or "high-fidelity" color printing has been developed, wherein a printing system capable of producing process color output images is augmented with additional inkjet cartridges containing additional primary colors beyond the usual four primaries colors used to produce the process color output. These additional inkjet cartridges are used for extending the color gamut of the process color output (high fidelity color), and thereby more closely emulate standardized spot colors, such as those defined by Pantone. As such, several concepts derived from conventional inkjet imaging techniques which were previously directed to monochrome and/or process color image formation have been modified to generate output images having selected areas that are different in color than the rest of the document. Applications of highlight color include, for example, emphasis on important information, accentuation of titles, and more generally, differentiation of specific areas of text or other image information.

One specific application of highlight color processing is customer selectable color printing, wherein a very specific highlight color is required. Customer selectable colors are typically utilized to provide instant identification and authenticity to a document. As such, the customer is usually highly concerned that the color meets particular color specifications. For example, the red color associated with Xerox' digital stylized "X" is a customer selectable color having a particular shade, hue and color value. Likewise, the particular shade of orange associated with Syracuse University is a good example of a customer selectable color. A more specialized example of a customer selectable color output can be found in the field of "custom color," which specifically refers to registered proprietary colors, as used, for example, in corporate logos, authorized letterhead and official seals. The yellow associated with Kodak brand products, and the brown associated with Hershey brand products are good examples of custom colors which are required to meet exacting color standards in a highlight color or spot color printing application.

A significant number of customer selectable colors cannot be accurately generated via halftone process color based on the standard four-color methods because the production of solid image areas of a particular color using halftone image processing techniques. Additionally the half tone process yields nonuniformity of the color in the image area which can be objectionable in some applications. Further, lines and text produced by halftone process color are very sensitive to misregistration of the multiple color images such that blurring, color variances, and other image quality defects may result.

As a result of the deficiencies noted above, it would be desirable for customer selectable color production in inkjet printing systems to be carried out by providing a singular premixed developing material composition made up of a mixture of multiple color inks blended in preselected concentrations for producing the desired customer selectable color output. Methods for mixing multiple color inks to produce a particular color printing material would be analogous to processes used to produce customer selectable color paints and inks for offset printing. In offset printing, for example, a customer selectable color output image can be produced by printing a solid image pattern with a premixed customer selectable color printing ink as opposed to printing a plurality of halftone image patterns with various primary colors or compliments thereof.

Customer selectable color printing materials including paints, printing inks and developing materials can be manufactured by determining precise amounts of constituent basic color components making up a given customer selectable color material, providing precisely measured amounts of each constituent basic color component, and thoroughly mixing these color components. This process is commonly facilitated by reference to a color guide or swatch book containing hundreds or even thousands of swatches illustrating different colors, wherein each color swatch is associated with a specific formulation of colorants. Probably the most popular of these color guides is published by Pantone®, Inc. of Moonachie, N.J. The Pantone® Color Formula Guide expresses colors using a certified matching system and provides the precise formulation necessary to produce a specific customer selectable color by physically intermixing predetermined concentrations of up to four colors from a set of up to 18 principal or basic colors. There are many colors available using the Pantone® system or other color formula guides of this nature that cannot be produced via typical halftone process color methods or even by mixing selected amounts of cyan, magenta, yellow and/or black inks or developing materials.

The following disclosures may be relevant to some aspects of the invention:

- U.S. Pat. No. 5,781,828 to Caruthers, Jr. et al., Liquid Color Mixing And Replenishment System For An Electrostatographic Printing Machine;
- U.S. Pat. No. 5,892,891 to Dalal et al., System For Printing Color Images With Extra Colorants In Addition To Primary Colorants;
- U.S. Pat. No. 5,897,239 to Caruthers, Jr. et al., Photometric Color Correction And Control System For Custom Colors;
- U.S. Pat. No. 5,899,605 to Caruthers, Jr. et al., Color Mixing And Color System For Use In A Printing Machine;
- U.S. Pat. No. 6,002,893 to Caruthers, Jr. et al., High And Low Pigment Loadings For Custom Colors;
- U.S. Pat. No. 6,052,195 to Mestha et al., Automatic Colorant Mixing Method And Apparatus; and
- U.S. Pat. No. 6,307,645 B1 to Mantell et al., Halftoning For Hi-Fi Color Inks.

U.S. Pat. No. 5,781,828 discloses a system and method for color mixing management in an electrostatographic printing system, wherein a developing material reservoir containing an operative solution of colored developing material including a mixture of selected color components is continuously replenished with selected differently colored developing material concentrates in a predetermined ratio so as to be capable of producing a customer selectable color image area on an output substrate. The '828 patent also discloses the mixing of a customer selectable color in situ, either from stored proportions known to compensate for developability differences or from approximate amounts of primary color components initially deposited and mixed in the developing material reservoir with the resultant operative developing material mixture continually developed and replenished with a predetermined ratio of color components until the developing material mixture reaches a steady state color.

U.S. Pat. No. 5,892, 891 discloses a "hi-fi" color printing system, wherein colorants beyond the regular CMYK primary colorants are available, a main gamut obtainable with the CMYK colorants only is mutually exclusive with at least one extended gamut in which a hi-fi colorant is used and a complementary one of the CMY colorants is excluded. Because the main and extended gamuts are mutually exclusive, no more than four colorants are used in any part of the image, and no more than four halftone screens need be used to obtain any desired color.

U.S. Pat. No. 5,897,239 discloses a system and method for color mixing control in a developing material-based electrostatographic printing system. A developing reservoir containing an operative solution of customer selectable colored developing material is continuously replenished with selectively variable amounts of basic color components making up the operative solution by controlling the rate of replenishment of various color components added to the supply reservoir. An optical sensor is used to measure the optical spectrum of the developed image so that the actual optical spectrum thereof can be brought into agreement with a target optical spectrum associated with a customer selectable color. The '239 system may be used to mix a customer selectable color in situ, whereby approximate amounts of primary color components are initially deposited and mixed in the developing material reservoir and the resultant developed image is monitored and adjusted until the mixture reaches a target optical spectrum. An additional optical sensor may be used to control and maintain the color of the developing material in the reservoir through continuous monitoring and correction in order to maintain a particular ratio of color components in the reservoir over extended periods associated with very long print runs.

U.S. Pat. No. 5,899,605 discloses a system for determining, in real time, the precise color measurements of a colorant being applied in a printing apparatus, the colorant being a combination of two or more primary colorants. Light from a light source is transmitted through or reflected from the colorant mixture, and received by a sensor having a relatively small number of photo detectors, each photo detector having a different translucent primary-color filter thereon. Various special algorithms can be used to approach the accuracy of a spectrophotometer using a relatively simple light sensor.

U.S. Pat. No. 6,002,893 discloses custom color control techniques that are extended by using a high and a low pigment loaded toner for each color of the primary colors in the printing system. In one application, a large gamut of colors and fine control of color is accomplished by using a minimum number of colored pigments with each color incorporated into both high and low pigment loaded toners. Another application of the high/low pigment loaded toners is the ability to increase the developed mass per unit area (DMA) for rough papers without increasing pigment mass per unit area (PMA) by either mixing high and low pigment-loaded toners or by mixing a high pigment-loaded toner with an unpigmented toner to obtain the desired custom color. A novel sensor which senses fluorescent molecules in toner particles provides a color independent measure of total toner solids.

U.S. Pat. No. 6,052,195 discloses a method of mixing colorants to achieve a target color includes combining individual colorants, detecting an output color of the combined colorants with a color sensing device and automatically adjusting the output color based on comparison between the detected output color and the target color. An apparatus for mixing colorants according to this method is also disclosed.

U.S. Pat. No. 6,307,645 B1 discloses a hi-fi color printing system wherein an inverted halftone screen is provided having the same angle and frequency as a half-tone screen for an opposing color. The dots of the inverse halftone screen are configured to be located midway between the centers of the dots of the half-tone screen. The halftone screen and inverted halftone screen are used in the printing process to extend the gamut of colors within a printing system, render improved neutral colors, and provide an improved transition through neutral regions of color space. The '645 system allows for additional printing of multiple colors without the need for increasing the number of screens used in the image processing system.

BRIEF SUMMARY OF INVENTION

In one aspect of the invention, one embodiment of an inkjet printing system is provided. In this embodiment, the inkjet printing system includes: multiple premixed ink channels, each premixed ink channel includes a print head for receiving a premixed ink cartridge with a machine-readable tag; an ink cartridge sensor associated with each premixed ink channel; and a controller.

In another aspect of the invention, a method for printing custom colors in an inkjet printing system with multiple ink cartridges, each ink cartridge including a machine-readable tag identifying the color of ink within the ink cartridge, is provided. The method includes: a) determining a first desired custom color to be printed; b) determining a second desired custom color to be printed; c) reading the machine-readable tags on each of the installed ink cartridges; d) determining if the ink in any of the installed ink cartridges matches the first desired custom color and, if so, printing in the first desired custom color; e) determining if the ink in any of the installed ink cartridges matches the second desired custom color and, if so, printing in the second desired custom color; f) if none of the installed ink cartridges contain ink matching the first desired custom color, replacing a first installed ink cartridge with a first uninstalled ink cartridge that matches the first desired color to be printed, then printing in the first desired custom color; and g) if none of the installed ink cartridges contain ink matching the second desired custom color, replacing a second installed ink cartridge with an second uninstalled ink cartridge that matches the second desired color to be printed, then printing in the second desired custom color. Printing of the first and second desired custom colors can be accomplished either serially or in an interlaced fashion.

In yet another aspect of the invention, another embodiment of an inkjet printing system is provided. In this embodiment, the inkjet printing system includes: 1) a first in situ mixed ink channel for receiving two or more of premixed ink supply dispensers, the premixed ink supply dispensers including a machine-readable tag identifying the color of ink within the premixed ink supply dispenser, the first in situ mixed ink channel including: a) ink supply dispenser sensors; b) supply valve members; c) a mixing reservoir; d) a pump motor; and e) a print head; and 2) a controller.

In still another aspect of the invention, a method for printing custom colors in an inkjet printing system with multiple ink supply dispensers using an in situ mixed ink channel, each ink supply dispenser including a machine-readable tag identifying the color of ink within the ink supply dispenser, is provided. The method includes: a) determining a first desired custom color to be printed; b) determining which ink supply dispensers are required to create an in situ mixed ink in the first desired custom color; c) reading the machine-readable tags on each of the installed ink supply dispensers; d) determining if all the ink supply dispensers required to create an in situ mixed ink in the first desired custom color are installed and, if so, mixing inks from the required ink supply dispensers in an appropriate ratio to create an in situ mixed ink in the first desired custom color and printing in the first desired custom color; and e) if any of the required ink supply dispensers are not installed, replacing an ink supply dispenser that is not required with a required ink supply dispenser until all of the required ink supply dispensers are installed, then mixing inks from the required ink supply dispensers in an appropriate ratio to create an in situ mixed ink in the first desired custom color and printing in the first desired custom color.

In still yet another aspect of the invention, an ink mixing station is provided. The ink mixing station includes: 1) a first in situ mixed ink channel for receiving two or more premixed ink supply dispensers, each premixed ink supply dispenser including a machine-readable tag identifying the color of ink within the premixed ink supply dispenser, the first in situ mixed ink channel including: a) an ink supply dispenser sensor for each premixed ink supply dispenser; b) a supply valve member for each premixed ink supply dispenser; c) a mixing reservoir; and d) a pump motor; and 2) a controller.

In yet another aspect of the invention, a method for mixing custom color inks and filling inkjet ink containers with the custom color ink in an ink mixing station with multiple ink supply dispensers, each ink supply dispenser including a machine-readable tag identifying the color of ink within the ink supply dispenser, is provided. The method includes: a) determining a first desired custom color to be filled in a first inkjet ink container; b) determining which ink supply dispensers are required to create an in situ mixed ink in the first desired custom color; c) reading the machine-readable tags on each of the installed ink supply dispensers; d) determining if all the ink supply dispensers required to create an in situ mixed ink in the first desired custom color are installed and, if so, mixing inks from the required ink supply dispensers in an appropriate ratio to create an in situ mixed ink in the first desired custom color and filling the first inkjet ink container; and e) if any of the required ink supply dispensers are not installed, replacing an ink supply dispenser that is not required with a required ink supply dispenser until all of the required ink supply dispensers are installed, then mixing inks from the required ink supply dispensers in an appropriate ratio to create an in situ mixed ink in the first desired custom color and filling the first inkjet ink container.

Benefits and advantages of the invention will become apparent to those of ordinary skill in the art upon reading and understanding the description of the invention provided herein.

BRIEF DESCRIPTION OF DRAWINGS

The invention is described in more detail in conjunction with a set of accompanying drawings.

DETAILED DESCRIPTION

Figure 1:
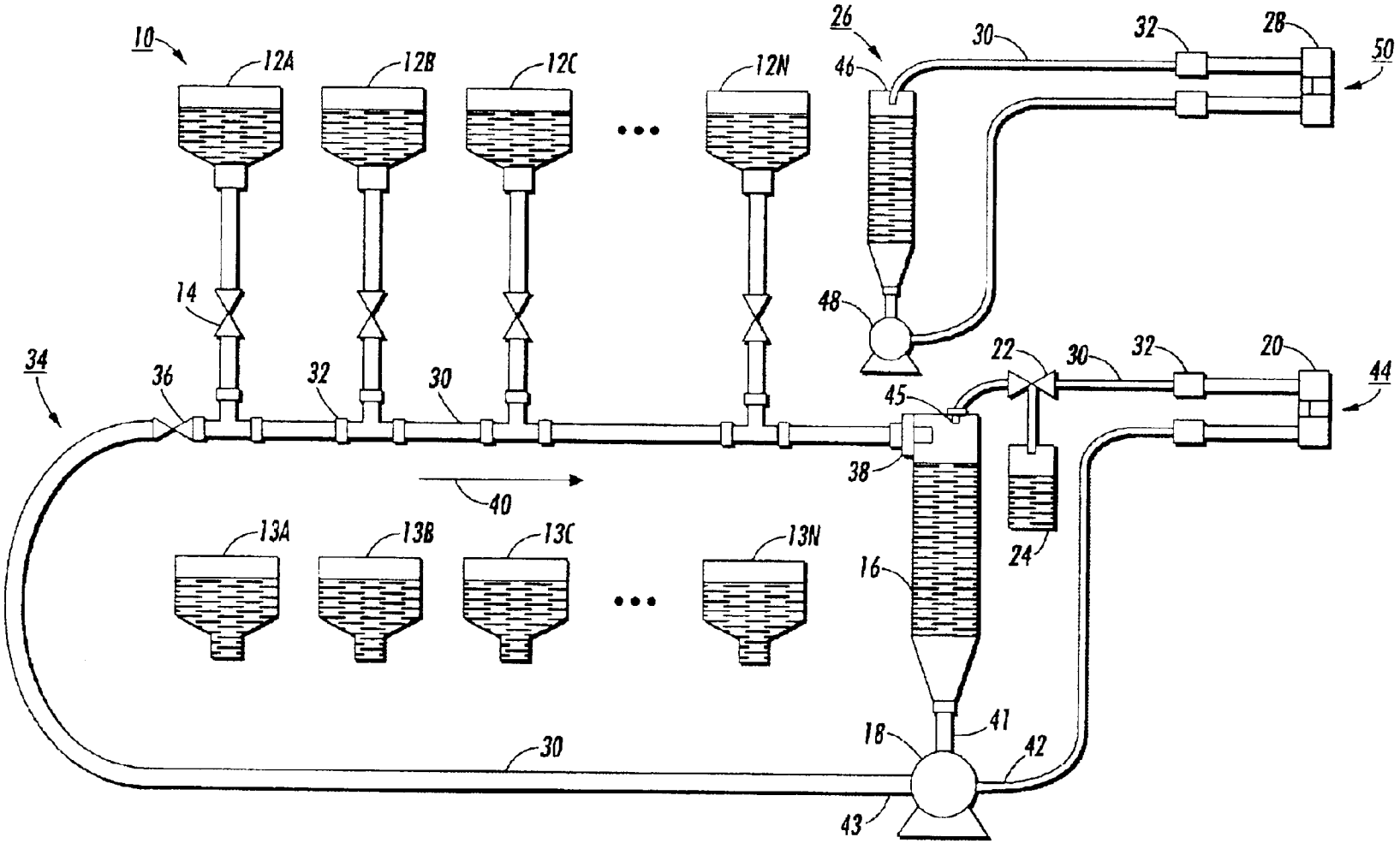
FIG. 1 is diagram showing the flow of ink in one embodiment of an inkjet printing system.

While the invention is described in conjunction with the accompanying drawings, the drawings are for purposes of illustrating exemplary embodiments of the invention and are not to be construed as limiting the invention to such embodiments. It is understood that the invention may take form in various components and arrangement of components and in various steps and arrangement of steps beyond those provided in the drawings and associated description. Within the drawings, like reference numerals denote like elements.

With reference to FIG. 1, a diagram showing the flow of ink in one embodiment of an inkjet printing system 10 is provided. In this embodiment, the system includes multiple installed ink supply dispensers 12A–N, multiple uninstalled ink supply dispensers 13A–N, a supply valve member 14 associated with each installed ink supply dispenser, an ink mixing reservoir 16, a pump motor 18 associated with the mixing reservoir 16, a first inkjet print head 20 associated with the mixing reservoir 16, a purging valve member 22 associated with the mixing reservoir 16, a waste collection container 24 associated with the purging valve member 22, a replaceable ink cartridge 26, a second inkjet print head 28 associated with the ink cartridge 26, various lengths of ink transport tubing 30, and various tubing connectors 32. The inkjet print heads 20, 28 may be thermal inkjet print heads, piezo-electric inkjet print heads, or any other type of inkjet print head known in the art. (In the case of thermal heads, of course the filling of the active chamber of the head relies on capillary forces and hence the pump delivers ink to the reservoir from which the capillary is supplied.)

The transport tubing 30 between the mixing reservoir 16 and the pump motor 18 forms an ink supply loop 34 for cleaning and purging the lines between mixing and printing in different desired colors. A supply of the colorless continuous phase of the ink formulations may be supplied in one of the ink reservoirs to aid in the purging process. A check valve member 36 is included in the ink supply loop 34 formed by various lengths of ink transport tubing 30 and tubing connectors 32 between the pump motor 18 and a supply inlet 38 to the mixing reservoir 16. The check valve member 36 ensures that ink in the ink supply loop 34 flows in the direction of arrow 40. In other words, the check valve member 36 blocks the flow of ink in the direction opposing arrow 40, so that when supply valve members 14 are open, ink flows to the mixing reservoir 16. The check valve member 36 may be replaced by a pump device or any other suitable flow control mechanism known in the art. However, the check valve member 36 is not a required component and in alternate embodiments may be removed.

The inkjet printing system 10 includes a feeding subsystem (not showing) for feeding print media through the system and a transport subsystem (not showing) for transporting the print heads in relation to the print media. Such system may also include driers, intermediate transfer devices and other active and passive subsystems appropriate for the choice on ink and head type as will be well known to those schooled in the art. In one embodiment of the system 10, the first print head 20 and second print head 28 are transported by the transport subsystem. In this other embodiment, appropriate sections of the ink transport tubing 30 are flexible to accommodate movement of the first print head 20 and second print head 28. In another embodiment of the system 10, the mixing reservoir 16, pump motor 18, first print head 20, print cartridge 26, and second print head 28 are transported by the transport subsystem. In this other embodiment, appropriate sections of the ink transport tubing 30 are flexible to accommodate movement of the mixing reservoir 16 and pump motor 18. In yet another embodiment of the system 10, all of the components shown in FIG. 1 are transported by the transport subsystem.

Each ink supply dispenser 12A–N, 13A–N in the inkjet printing system 10 contains a different color of ink. Typically, the system 10 includes up to four installed ink supply dispensers. However, the system 10 may be adapted for a higher or lower capacity of installed ink supply dispensers. The total number of ink supply dispensers required to be installed in the system 10 at any particular time is dependent on the desired color to be printed. Hence, less than the full capacity of ink supply dispensers may be required for certain desired colors. The total number of ink supply dispensers 12, 13 available in the system 10 is dependent on the overall number and range of colors desired to be printed. In one embodiment, the system 10 includes 18 ink supply dispensers with a capacity for installing up to four ink supply dispensers at any one time. In this embodiment, each ink supply dispenser contains a principal or basic color with respect to the Pantone® color matching system and the system can mix and print over a thousand different standardized colors. In another embodiment, the system 10 includes eight ink supply dispensers 12, 13 with individual dispensers containing cyan, magenta, yellow, red, green, blue, light magenta, dark magenta, and orange inks.

Each installed ink supply dispenser 12A–N is in fluidic communication with a supply valve member 14. Each supply valve member 14 is in fluidic communication with the mixing reservoir 16. The supply valve member 14 opens and closes to control the flow of ink from an associated ink supply dispenser to the mixing reservoir 16. Any supply valve member 14 may be replaced by a pump device or any other suitable flow control mechanism known in the art.

The mixing reservoir 16 is in fluidic communication with an inlet 41 to the pump motor 18. The pump motor 18 routes ink from the inlet 41 to a first outlet 42 that is in fluidic communication with the first print head 20. The pump motor 18, via a second outlet 43, is also in fluidic communication with the ink supply loop 34. The first and second outlets 42, 43 of the pump motor 18 are isolated from each other. The system 10 typically uses the second outlet 43 on the pump motor 18 for purging the ink supply loop 34. Therefore, usually the second outlet 43 of the pump motor 18 is also isolated from the inlet 41 to the pump motor 18.

The mixing reservoir 16, pump motor 18, first print head 20, and associated interconnecting components form a first ink channel 44 for printing ink on a target media via the first print head 20. Typically, the ink printed by the first print head 20 is a customer selected or custom color ink mixed in mixing reservoir 16. However, ink from any individual installed ink supply dispenser may also be directed through the mixing reservoir 16 and printed by the first print head 20. For example, cyan, magenta, and yellow ink supply dispensers 12 may be installed to print images using conventional "process color" techniques (i.e., overspray printing or half-tone pattern printing, rather than pre-mixing) via the first ink channel 44.

The first print head 20 is in fluidic communication with the purging valve member 22. The purging valve member 22 switches ink flowing from first print head 20 between the mixing reservoir 16 and the waste collection container 24. The purging valve member 22 may be replaced by a pump device or any other suitable flow control mechanism known in the art. In a first position, ink flowing through the purging valve member 22 is in fluidic communication with a return inlet 45 on the mixing reservoir 16. In this position, the purging valve member 22 and associating transport tubing 30 provides a return path for excess ink from the first print head 20 to the mixing reservoir 16. In a second position, ink flowing through the purging valve member 22 is in fluidic communication with the waste collection container 24. Normally, the purging valve member 22 is in the first position when the system 10 is printing via the first print head 20 and in the second position during purging (i.e., after such printing is completed).

The ink cartridge 26 may include an ink supply dispenser 46 and a pump motor 48 interconnected in a manner similar to the mixing reservoir 16 and pump motor 18 of the first ink channel 44. Alternatively, the ink cartridge 26 may be replaced by any suitable inkjet ink cartridge known in the art. The ink cartridge 26 is in fluidic communication with the second print head 28 via two independent ink transport tubes 30. A first tube supplies ink from the ink cartridge 26 to the second print head 28, while a second tube provides a return path for excess ink from the print head 28 to the ink cartridge 26. The ink cartridge 26, second print head 28, and associated interconnecting components form a second ink channel 50 for printing ink on a target media via the second print head 28.

Typically, the ink contained in the ink cartridge 26 and thereby printed by the second print head 20 is a standard color (e.g., black). However, the ink cartridge may also contain any other basic or primary ink (e.g., cyan, magenta, yellow, or red), or a premixed custom color ink. Alternatively, in another embodiment of the system 10, the second ink channel 50 may removed, leaving the first ink channel 44 for in situ mixing and printing of the desired colors of ink.

Figure 2:
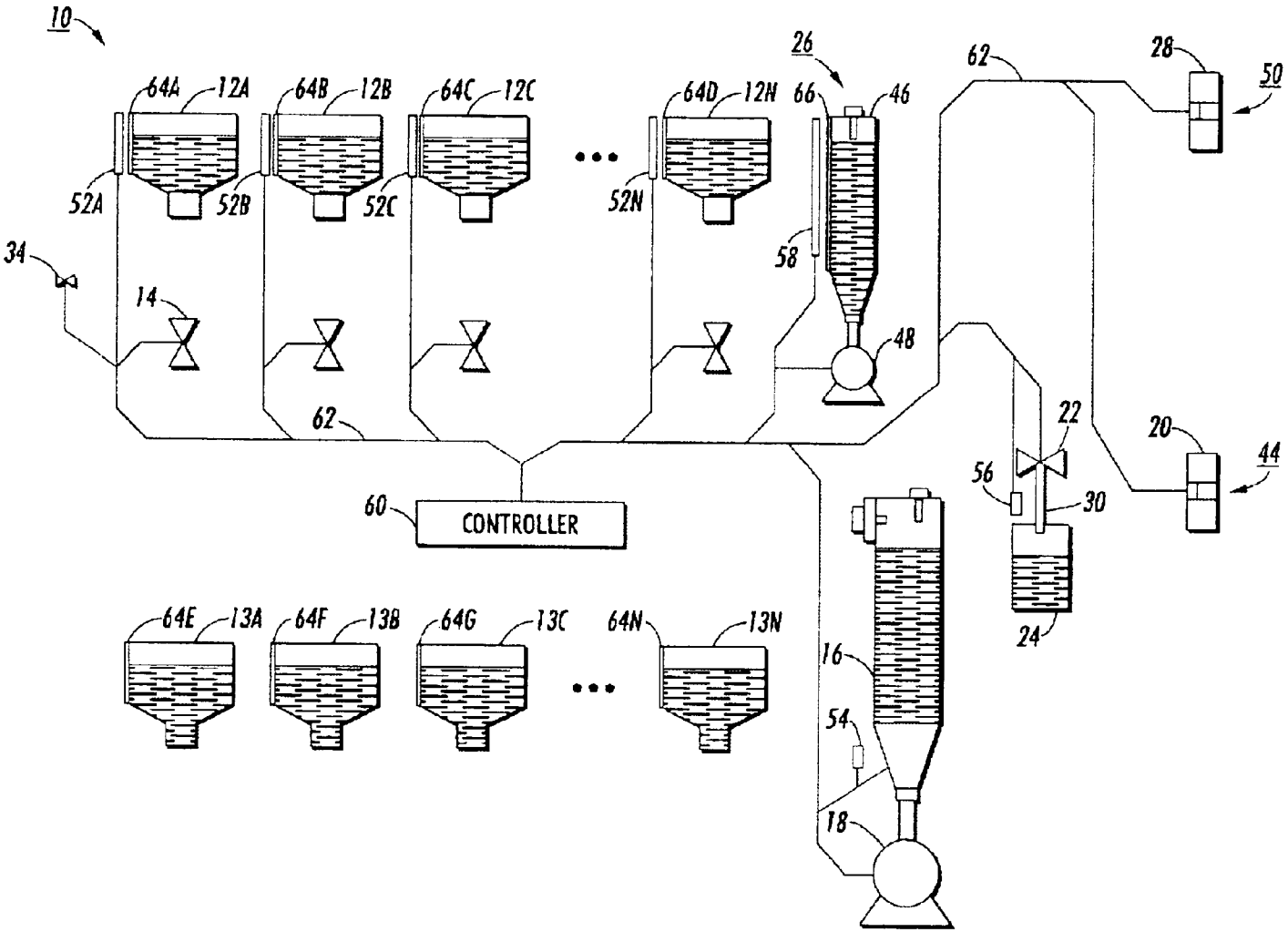
FIG. 2 is an electrical diagram of the inkjet printing system shown in FIG. 1.

With reference to FIG. 2, an electrical diagram of the inkjet printing system 10 shown in FIG. 1 is provided. As shown in the electrical schematic diagram, in addition to the components described above, the system 10 also includes multiple ink supply dispenser sensors 52A–N associated with each installed ink supply dispenser 12A–N, a colorimetric sensor 54 associated with the mixing reservoir 16, an ink sensor 56 associated with the ink transport tubing 30 between the purging valve member 22 and the waste collection container 24, an ink cartridge sensor 58 associated with the ink cartridge 26, a controller 60, and various types of electrical conductors 62 interconnecting the electrical components of the system. Additionally, each ink supply dispenser 12A–N, 13A–N includes a machine-readable tag 64A–N and the ink cartridge includes a similar machine-readable tag 66. The supply valve members 14, mixing reservoir 16, pump motor 18, first inkjet print head 20, purging valve member 22, ink cartridge 26, second inkjet print head 28, and check valve member 36 from the diagram of showing the flow of ink (FIG. 1) are also identified as electrical components. Alternatively, the check valve member 36 may be purely mechanical without any electrical interface.

The controller 60 may take the form of any processing device known in the art. The controller 60 is operationally coupled to the sensors (52A–N, 54, 56, and 58), the valve members (14, 22, and 36), the mixing reservoir 16, the pump motor 18, the print heads (20, 28), and the ink cartridge 26.

The controller 60 operates in conjunction with image processing operations within the inkjet printing system 10. The basic, primary, and/or premixed colored inks available in ink supply dispensers and/or ink cartridges 26 are known by the controller 60 for any given embodiment of a system 10. The controller 60 also knows the maximum number of ink supply dispensers that can be installed and the color gamuts for high-fidelity printing, spot color printing, and process color printing that are available based on the available dispensers and the capacity for installing multiple dispensers. As such, image processing operations within the system 10 determine the colors to be printed for an input image and the sequence for printing such colors based on known characteristics of ink and color matching for the inks available in the system 10. Additionally, image processing operations may identify whether a given color is to be printed from the first ink channel 44 using the mixing reservoir 16 or from the second ink channel 50 using an ink cartridge 26.

If the desired color is to be printed from the first ink channel 44, the controller 60 closes the supply valve members 14 and controls the pump motor 18 and purging valve member 22 to clear the transport tubing 30, mixing reservoir 16, and first inkjet print head 20 of any remaining ink from the last time the first ink channel 44 was used. The ink sensor 56 provides the controller with feedback associated with the flow of ink between the purging valve member 22 and the waste collection container 24. When the feedback from the ink sensor 56 indicates that no ink is flowing between the purging valve member 22 and the waste collection container 24, the purging process is complete and the controller 60 switches the purging valve member 22 to return ink to the mixing reservoir 16 to enable in situ color mixing and printing.

After purging the first ink channel 44, the controller 60 determines which ink supply dispensers are required to print the next desired color. The controller 60 reads the machine-readable tags 64A–N on the installed ink supply dispensers 12A–N via the ink supply dispenser sensors 52A–N to determine if the required ink supply dispensers are installed. If any of the required ink supply dispensers are not installed, the controller 60 communicates an appropriate error message to the user. For example, the controller 60 presents a message instructing the user to replace certain installed ink supply dispensers that are not required with the one or more required ink supply dispensers in order to print the desired color. Alternately, the system 10 may be adapted to automatically replace ink supply dispensers as directed by the controller 60.

Once the required ink supply dispensers are installed, the controller 60 controls the appropriate supply valve members 14 to supply ink from each of the required ink supply dispensers. The amount of ink from each of the required ink supply dispensers is metered out by the controller 60 based on the color mix required for the desired color and the amount of the desired color required for the current page or sheet of media. The controller 60 controls the mixing reservoir 16 to create an in situ mix of the desired color. The calorimetric sensor 54 provides the controller 60 with feedback of the actual color of the in situ mix and the level of ink in the mixing reservoir 16. The controller 60 individually adjusts the supply valve members 14 to control the amount of ink being metered out based on the feedback from the calorimetric sensor 54 with respect to the actual color of the in situ mix. The controller 60 also determine an approximate volume of in situ mixed ink required and closes the supply valve members 14 to stop the flow of ink from the required ink supply dispensers when the approximate volume of in situ mixed ink required is reached based on the feedback from the calorimetric sensor 54 with respect to the level of ink in the mixing reservoir 16. If a predetermined level of ink (referred to generally as a full level) is reached in the mixing reservoir before the approximate volume of in situ mixed ink required is reached, the controller 60 temporarily stop the flow of ink from the required ink supply dispensers and begins printing. For printing, the controller 60 controls the first print head 20, the transport subsystem, and the feeding subsystem to position the first print head 20 and the print media for printing the desired color at the appropriate points on the current page or sheet of print media. As printing activities continue, the controller 60 monitors the level of the in situ mixed ink in the mixing reservoir 16 via the colorimetric sensor 54 and as it is depleted, if the approximate volume of in situ mixed ink required has not been mixed, controls the appropriate supply valve members 14 to replenish the mixing reservoir 16 with the appropriate amounts of ink from the required ink supply dispensers until the approximate volume of in situ mixed ink required has been mixed.

Preferably, the required amount of ink from each required ink supply dispenser is approximated and metered out for in situ mixing. This minimizes waste of ink and the time required for cleaning and purging the first ink channel 44. The purging process described above is also performed after in situ mixing and printing of the desired color on the current page is completed. If another color is to be printed from the first ink channel 44, the purging step at the beginning of the in situ mixing and printing process for the next color may be skipped because it would be redundant. Alternate cleaning and purging processes are contemplated. In particular, selection of specific components for valve members, transport tubing, and mixing pumps may require simplified or more complex configurations and process steps to properly accomplish cleaning and purging. For example, in an alternate embodiment, a cleaning fluid may be dispensed and circulated through the first ink channel 44 and expelled to the waste collection container to clean and purge the lines.

If the desired color is to be printed from the second ink channel 50, the controller 60 reads the machine-readable tag 66 on the installed ink cartridge 26 to determine if the correct ink cartridge 26 is installed. If the correct ink cartridge 26 is not installed, the controller 60 communicates an appropriate error message to the user. For example, if the system 10 has an ink cartridge containing ink of the desired color, the controller 60 presents a message instructing the user to install the required ink cartridge. Once the correct ink cartridge 26 is installed, the controller 60 prints the desired color using the second ink channel 50. Alternatively, the system 10 may be adapted to automatically replace ink cartridges as directed by the controller 60.

In summary, the inkjet printing system 10 may be used to print in situ mixtures of basic, primary, or custom colors (depending on the ink supply dispensers available) via the first ink channel 44 and premixed basic, primary, or custom colors (depending on the ink cartridges available) via the second ink channel 50. Alternative uses of system 10 are also possible. For example, the first ink channel 44 may be used to print with ink from any individual ink supply dispenser 12 without mixing. One embodiment of the system 10 may include 18 basic and primary color ink supply dispensers with the capacity to install up to four dispensers at one time for printing over a thousand standardized custom colors via the first ink channel 44 and a black ink cartridge for printing over the second ink channel 50.

Various alternate configurations of an inkjet printing system 10 are also contemplated. For example, additional in situ mixing ink channels, like the first ink channel 44, can be added to the system 10 of FIG. 1 by adding mixing reservoirs 16, print heads 20, and associated interconnecting components to form additional ink channels capable of printing custom color ink on a target media. The inkjet printing system 110 depicted in FIG. 3 is an example of this configuration.

Figure 4:
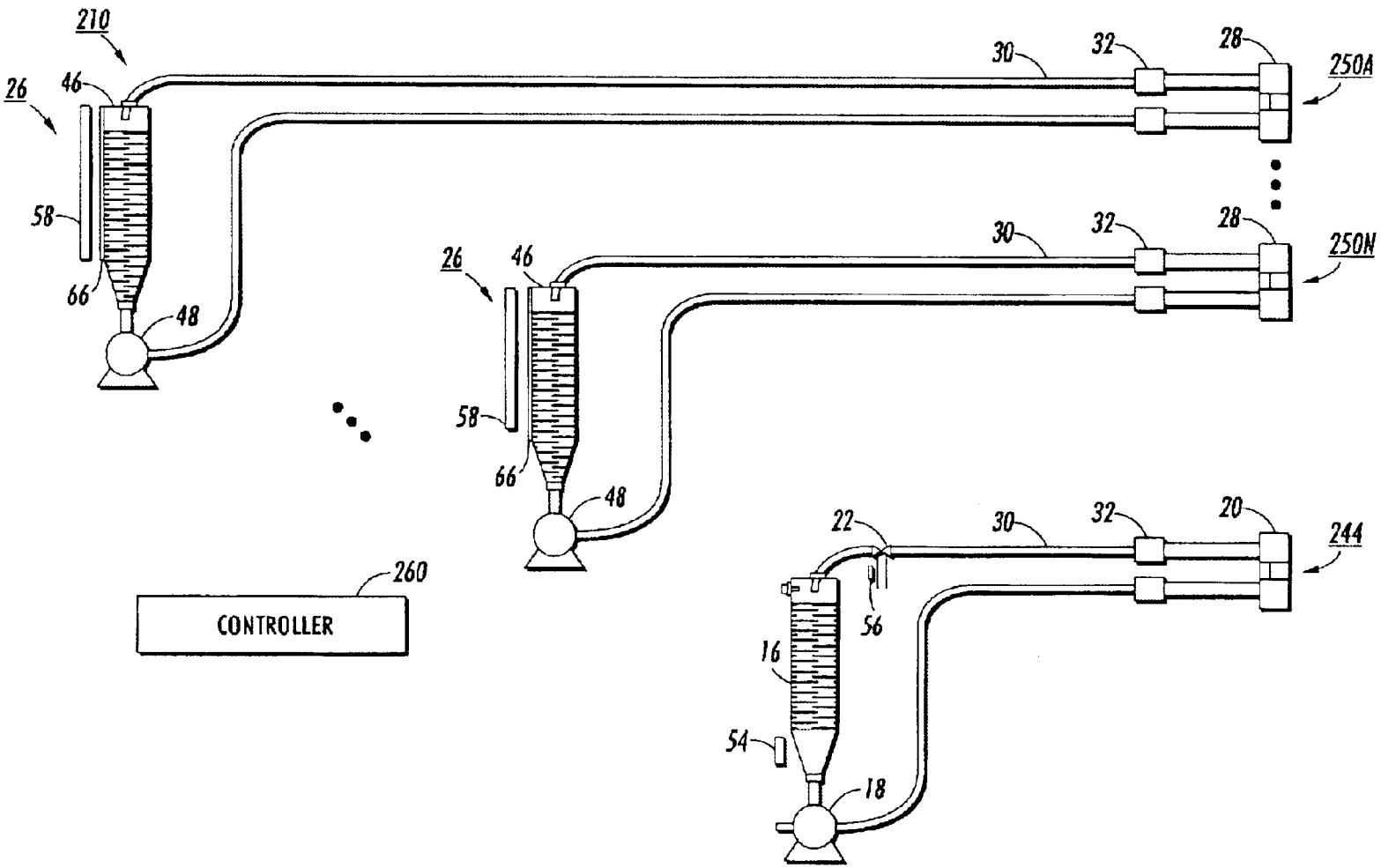
FIG. 4 is a diagram showing yet another embodiment of an inkjet printing system.

Similarly, more premixed ink channels, like the second ink channel 50, can be added to the system 10 of FIG. 1 by adding ink cartridges 26, print heads 28, and associated interconnecting components to form additional ink channels capable of printing ink from the additional ink cartridges on a target media. The inkjet printing system 210 depicted in FIG. 4 is an example of this configuration. The system 210 of FIG. 4 can be altered by removing the in situ mixing channel, like the first ink channel 44, to create yet another embodiment with multiple premixed ink channels, like the second ink channel 50. In this embodiment, the machine-readable tags permit the full range of image processing techniques described herein because a set of individual ink cartridges may include cartridges with ink in basic, primary, and custom colors.

Figure 3:
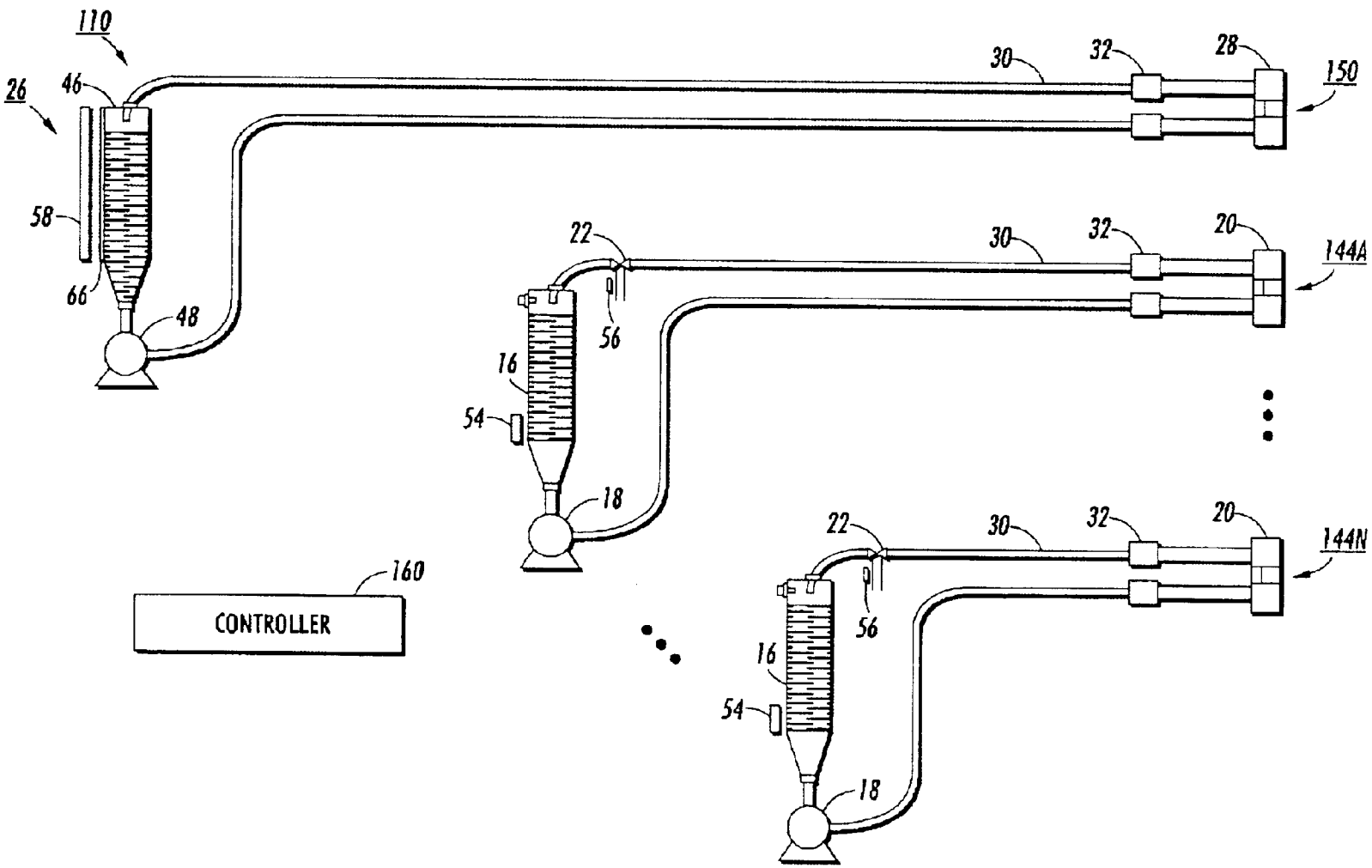
FIG. 3 is a diagram showing another embodiment of an inkjet printing system.

With further reference to FIG. 3, a diagram showing another embodiment of an inkjet printing system 110 is provided. In this embodiment, the system includes multiple in situ mixed ink channels 144A–N (similar to the first ink channel 44 in FIGS. 1 and 2), a premixed ink channel 150 (similar to the second ink channel 50 in FIGS. 1 and 2), a controller 160 (similar to the controller 60 in FIG. 2), various lengths of ink transport tubing 30 (partially shown) and various tubing connectors 32 (partially shown) interconnecting the fluidic components of the system, and various types of electrical conductors 62 (not shown) interconnecting the electrical components of the system.

In conjunction with the in situ mixed ink channels 144A–N, the inkjet printing system 110 includes multiple installed ink supply dispensers 12A–N (not shown), multiple ink supply dispenser sensors 54A–N (not shown) associated with each installed ink supply dispenser, and multiple uninstalled ink supply dispensers 13A–N (not shown). Additionally, each ink supply dispenser includes a machine-readable tag 64A–N (not shown). Each in situ mixed ink channel includes a supply valve member 14 (not shown) associated with each installed ink supply dispenser, an ink mixing reservoir 16, a colorimetric sensor 54 associated with the mixing reservoir 16, a pump motor 18, an in situ mixed inkjet print head 20, a purging valve member 22, and a check valve member 36.

In one embodiment, the system 110 includes one waste collection member 24 (not shown) associated with the purging valve members 22. Alternatively, the system may include multiple waste collection members 24 with a waste collection member 24 associated with each purging valve member 22 or with waste collection members 24 shared by pairs or groups of purging valve members 22. Additionally, in conjunction with the purging valve member 22, each in situ mixed channel may include an ink sensor 56 between the purging valve member 22 and the waste container 24.

In one embodiment, the system 110 includes one set of ink supply dispensers. In this arrangement, the supply valve members for each in situ mixing channel are interconnected in parallel to the installed ink supply dispensers. Alternatively, each in situ mixing ink channel may include its own set of ink supply dispensers or multiple sets of ink supply dispensers may be shared by pairs or groups of in situ mixing ink channels. Where pairs or groups share a set of ink supply dispensers, the supply valve members for each in situ mixing channel in the pair or group are interconnected in parallel to the shared dispensers.

The operation of each in situ mixed ink channel 144A–N is the same as described above for the first ink channel 44 of FIGS. 1 and 2. System 110, with multiple in situ mixed ink channels, has the capability of printing multiple custom colors simultaneously and/or the ability to continue printing additional custom colors while previously used in situ mixed ink channels are cleaned and purged.

In conjunction with the premixed ink channel 150, the inkjet printing system 110 includes a replaceable ink cartridge 26, an ink cartridge sensor 56 associated with the ink cartridge 26, and a premixed inkjet print head 28. The ink cartridge 26 may include an ink supply dispenser 46 and a pump motor 48 interconnected in a manner similar to the mixing reservoir 16 and pump motor 18 of the in situ mixed ink channel 144A–N. Alternatively, the ink cartridge 26 may be replaced by any suitable inkjet ink cartridge known in the art. Additionally, the ink cartridge 26 includes a machine-readable tag 66 similar to the machine-readable tags 64A–N on the ink supply dispensers.

The operation of the premixed ink channel 150 is the same as described above for the second ink channel 50 of FIGS. 1 and 2. In an alternate embodiment of the system 110, the premixed ink channel 150 may be removed, leaving the multiple in situ mixed ink channels 144A–N for in situ mixing and custom color printing.

With further reference to FIG. 4, a diagram showing yet another embodiment of an inkjet printing system 210 is provided. In this embodiment, the system includes an in situ mixing ink channel 244 (similar to the first ink channel 44 in FIGS. 1 and 2), multiple premixed ink channels 250A–N (similar to the second ink channel 50 in FIGS. 1 and 2), a controller 260 (similar to the controller 60 in FIG. 2), various lengths of in transport tubing 30 (partially shown) and various tubing connectors 32 (partially shown) interconnecting the fluidic components of the system, and various types of electrical conductors 62 (not shown) interconnecting the electrical components of the system.

In conjunction with the in situ mixed ink channel 244, the inkjet printing system 210 includes multiple installed ink supply dispensers 12A–N (not shown), multiple ink supply dispenser sensors 54A–N (not shown) associated with each installed ink supply dispenser, and multiple uninstalled ink supply dispensers 13A–N (not shown). Additionally, each ink supply dispenser includes a machine-readable tag 64A–N (not shown). The in situ mixed ink channel 244 includes a supply valve member 14 (not shown) associated with each installed ink supply dispenser, an ink mixing reservoir 16, a colorimetric sensor 54 associated with the mixing reservoir 16, a pump motor 18, an in situ mixed inkjet print head 20, a purging valve member 22, a waste collection member 24 (not shown) associated with the purging valve member, an ink sensor 56 between the purging valve member 22 and the waste container 24, and a check valve member 36.

The operation of each in situ mixed ink channel 244 is the same as described above for the first ink channel 44 of FIGS. 1 and 2. In an alternate embodiment of the system 210, the in situ mixed ink channel 244 may be removed, leaving the multiple premixed ink channels 250A–N for standard and custom color printing.

Each premixed ink channel includes a replaceable ink cartridge 26, an ink cartridge sensor 56 associated with the ink cartridge 26, and a premixed inkjet print head 28. The ink cartridge 26 may include an ink supply dispenser 46 and a pump motor 48 interconnected in a manner similar to the mixing reservoir 16 and pump motor 18 of the in situ mixed ink channel 244. Alternatively, the ink cartridge 26 may be replaced by any suitable inkjet ink cartridge known in the art. Additionally, the ink cartridge 26 includes a machine-readable tag 66 similar to the machine-readable tags 64A–N on the ink supply dispensers.

The operation of the premixed ink channel 150 is the same as described above for the second ink channel 50 of FIGS. 1 and 2. Some of the advantages of the system 210 with multiple premixed ink channels include its ability to be used for custom color printing, highlight color printing, spot color printing, high fidelity color printing, or process color printing.

The various embodiments of inkjet printing systems described above are suitable for printing large format media in custom colors. Large format media, for example, includes paper, textile, mylar, metallic substrates, and plastics. Inkjet printing on such media may be for banners, posters, wallpaper, advertisements, photo prints, reprints of paintings, and fabric prints. Custom color inkjet printing becomes feasible and affordable for very low quantities using the inkjet printing system and associated methods of operation described above. In addition, the various embodiments of inkjet printing systems described above may be adapted to operate in an electrophotographic printing system.

Figure 5:
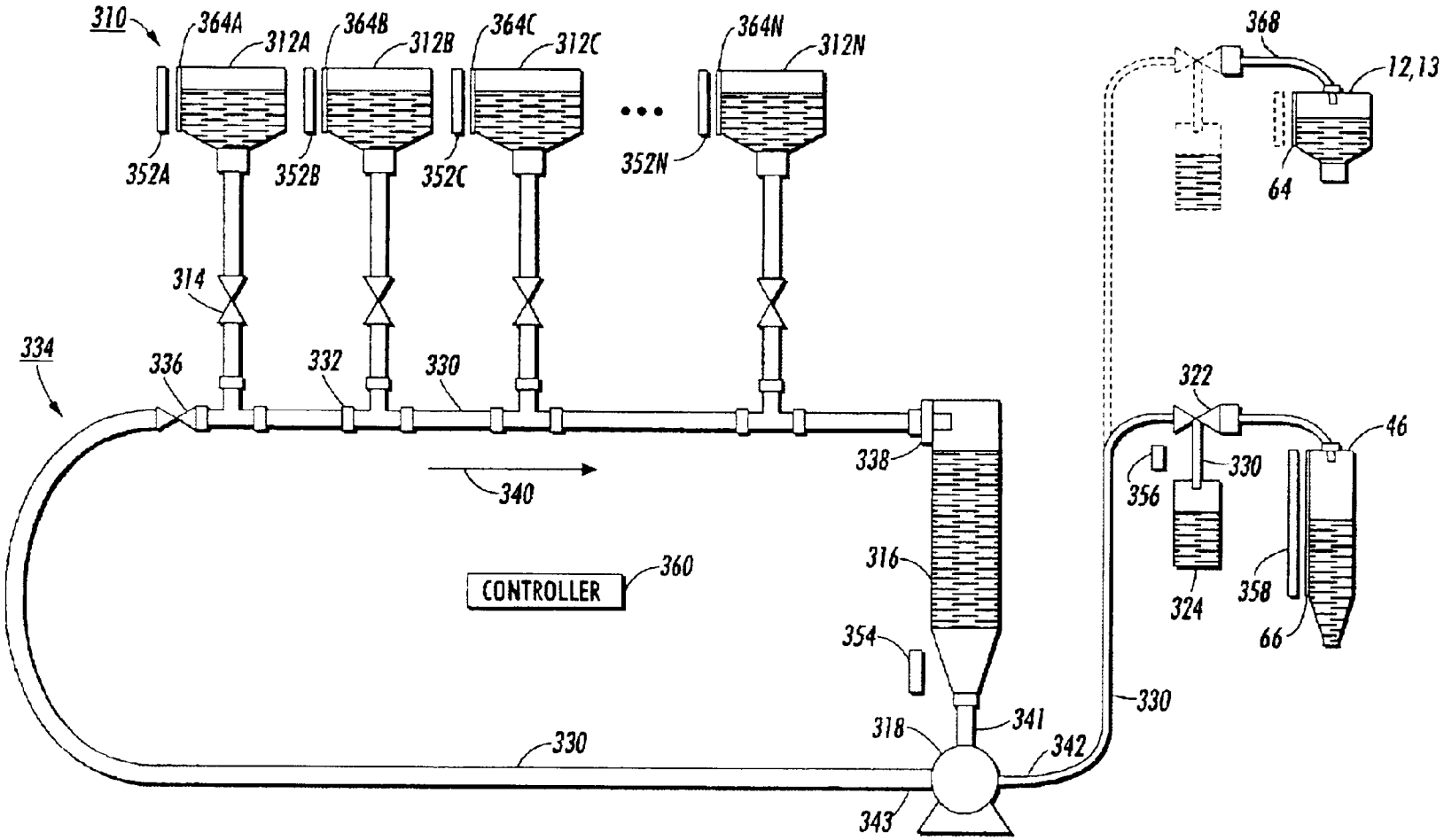
FIG. 5 is a diagram showing the flow of ink in one embodiment of an ink mixing station.

With reference to FIG. 5, a diagram showing the flow of ink in one embodiment of an ink mixing station 310 is provided. The ink mixing station 310 is show with an inkjet printer ink cartridge 26 like those used in the inkjet printing systems (e.g., 10, 110, 210) shown in FIGS. 1–4 installed for filling. However, the ink mixing station 310 is also adapted to fill inkjet printer ink supply dispensers 12, 13 like those used in the inkjet printing systems (e.g., 10, 110, 210) shown in FIGS. 1–4. When station 310 operations apply to both inkjet printer ink supply dispensers 12, 13 and inkjet printer ink cartridges 26, they are collectively referred to as an inkjet ink container. In the embodiment shown, the ink mixing station 310 includes multiple installed ink supply dispensers 312A–N, multiple uninstalled ink supply dispensers 313A–N (not shown; but interchangeable with the installed ink supply dispensers), a supply valve member 314 associated with each installed ink supply dispenser, an ink mixing reservoir 316, a pump motor 318, a purging valve member 322, a waste collection container 324 associated with the purging valve member, various lengths of ink transport tubing 330, various tubing connectors 332, and an adapter tubing member 368 associated with filling an inkjet print ink supply dispenser 12, 13. The adapter tubing member 368 if the tubing interface in the inkjet print ink supply dispenser 12, 13 is adapted for direct installation to the station 310.

The transport tubing 330 between the mixing reservoir 316 and the pump motor 318 forms an ink supply loop 334 for cleaning and purging the lines between mixing and filling inkjet ink containers with different colors. A check valve member 336 is included in the ink supply loop 334 formed by various lengths of ink transport tubing 330 and tubing connectors 332 between the pump motor 318 and a supply inlet 338 to the mixing reservoir 316. The check valve member 336 ensures that ink in the ink supply loop 334 flows in the direction of arrow 340. In other words, the check valve member 336 blocks the flow of ink in the direction opposing arrow 340, so that when supply valve members 314 are open, ink flows to the mixing reservoir 316. The check valve member 336 may be replaced by a pump device or any other suitable flow control mechanism known in the art. However, the check valve member 336 is not a required component and in alternate embodiments may be removed.

Each ink supply dispenser in the ink mixing station 310 may contain a different color of ink (in some cases the same color may be in more than one dispenser). Typically, the station 310 includes up to four installed ink supply dispensers. However, the station 310 may be adapted for a higher or lower capacity of installed ink supply dispensers 312A–N. The total number of ink supply dispensers required to be installed in the station 310 at any particular time is dependent on the desired color to be mixed and filled in an inkjet ink container. Hence, less than the full capacity of ink supply dispensers 312A–N may be required for certain desired colors.

The total number of ink supply dispensers available to the station 310 is dependent on the overall number and range of colors desired to be mixed. In one embodiment, the station 310 includes 18 ink supply dispensers with a capacity for installing up to four ink supply dispensers at any one time. In this embodiment, each ink supply dispenser contains a principal or basic color with respect to the Pantone® color matching system and the system can mix over a thousand different colors. In another embodiment, the station 310 includes eight ink supply dispensers with individual dispensers containing cyan, magenta, yellow, red, green, blue, light magenta, dark magenta, and orange inks. Typically, the desired color to be mixed is a customer selected or custom color. However, ink from any individual installed ink supply dispenser may also be directed through the mixing reservoir 316 to fill the inkjet ink container.

Installed ink supply dispensers 312A–N are in fluidic communication with a supply valve member 314. Supply valve members 314 are in fluidic communication with the mixing reservoir 316. The supply valve member 314 opens and closes to control the flow of ink from an associated ink supply dispenser to the mixing reservoir 316. Any supply valve member 314 may be replaced by a pump device or any other suitable flow control mechanism known in the art.

The mixing reservoir 316 is in fluidic communication with an inlet 341 to the pump motor 318. The pump motor 318 routes ink from the inlet 341 to a first outlet 342 that is in fluidic communication with the purging valve member 322. The pump motor 318, via a second outlet 343, is also in fluidic communication with the ink supply loop 334. The first and second outlets 342, 343 of the pump motor 318 are isolated from each other. The station 310 typically uses the second outlet 343 on the pump motor 318 for purging the ink supply loop 334. Therefore, usually the second outlet 343 of the pump motor 318 is also isolated from the inlet 341 to the pump motor 318.

When installed for filling, the inkjet ink container is also in fluidic communication with the purging valve member 322. The purging valve member 322 switches ink flowing from the mixing reservoir 316 between the inkjet ink container to be filled and the waste collection container 324. The purging valve member 322 may be replaced by a pump device or any other suitable flow control mechanism known in the art. In a first position, ink flowing through the purging valve member 322 is in fluidic communication with the inkjet ink container. In this position, the purging valve member 322 and associating transport tubing 330 provides a path for ink to flow to the installed inkjet ink container. In a second position, ink flowing through the purging valve member 322 is in fluidic communication with the waste collection container 324. Normally, the purging valve member 322 is in the first position when the station 310 is filling an inkjet ink container with in situ mixed ink and in the second position during purging and cleaning of the station 310.

In addition to the components described above, the station 310 also includes multiple ink supply dispenser sensors 352A–N associated with each installed ink supply dispenser 312A–N, a colorimetric sensor 354 associated with the mixing reservoir 316, an ink sensor 356 associated with the ink transport tubing 330 between the purging valve member 322 and the waste collection container 324, an inkjet ink container sensor 358 associated with an installed inkjet ink container, and various types of electrical conductors 362 (not shown) interconnecting the electrical components of the system. Additionally, each ink supply dispenser includes a machine-readable tag 364A–N. The inkjet ink containers typically include a machine-readable tag, similar to the machine-readable tags 364A–N. For inkjet printer ink supply dispensers 12, 13, the machine-readable tag 64 is as described above for inkjet print systems 10, 110, 210. For inkjet printer ink cartridges 26, the machine-readable tag 66 is also as described above for inkjet print systems 10, 110, 210. The supply valve members 314, mixing reservoir 316, pump motor 318, purging valve member 322, and check valve member 336 are also electrical components. Alternatively, the check valve member 336 may be purely mechanical without any electrical interface.

The controller 360 may take the form of any processing device known in the art. The controller 360 is operationally coupled to the sensors (352A–N, 354, 356, 358), the valve members (314, 322, 336), the mixing reservoir 316, and the pump motor 318.

The controller 360 operates in conjunction with ink mixing operations within the ink mixing station 310. The basic, primary, and/or premixed colored inks available in ink supply dispensers are known by the controller 360 for any given embodiment of the station 310. The controller 360 also knows the maximum number of ink supply dispensers that can be installed and the color gamuts from mixing the basic, primary, and/or premixed colored inks that are available from various arrangements of installed dispensers. As such, the controller 360 determines the colors to be mixed for a desired color selected by the user. Alternatively, the desired color may be determined using the inkjet ink container sensor 358 to read the machine-readable tag (64, 66) on an installed inkjet ink container.

Next, the controller 360 closes the supply valve members 314, controls the pump motor 318, and switches the purging valve member 322 to its second position to clear the transport tubing 330 and mixing reservoir 316 of any remaining ink from the last time the station 310 was used. The ink sensor 356 provides the controller 360 with feedback associated with the flow of ink between the purging valve member 322 and the waste collection container 324. When the feedback from the ink sensor 356 indicates that no ink is flowing between the purging valve member 322 and the waste collection container 324, the purging process is complete and the controller 360 presents a message instructing the user to install the next inkjet ink container to be filled. Alternatively, the station 310 may be adapted to automatically install inkjet ink containers from a queue of inkjet ink containers waiting to be filled as directed by the controller 360. Once the inkjet ink container is installed, the controller 360 switches the purging valve member 322 to its first position permit ink to flow from the mixing reservoir 316 to the installed inkjet ink container.

After the inkjet ink container is installed, the controller 360 determines which ink supply dispensers are required to fill the inkjet ink container with the desired color. The controller 360 reads the machine-readable tags 364A–N on the installed ink supply dispensers 312A–N via the ink supply dispenser sensors 352A–N to determine if the required ink supply dispensers are installed. If any of the required ink supply dispensers are not installed, the controller 360 communicates an appropriate error message to the user. For example, the controller 360 presents a message instructing the user to replace certain installed ink supply dispensers that are not required with the one or more required ink supply dispensers in order to print the desired color. Alternatively, the station 310 may be adapted to automatically replace ink supply dispensers as directed by the controller 360.

Once the required ink supply dispensers are installed, the controller 360 controls the appropriate supply valve members 314 to supply ink from each of the required ink supply dispensers. The amount of ink from each of the required ink supply dispensers is metered out by the controller 360 based on the color mix required for the desired color and the amount of the desired color required to fill the inkjet ink container. The controller 360 controls the mixing reservoir 316 to create an in situ mix of the desired color. The colorimetric sensor 354 provides the controller 360 with feedback of the level of ink in the mixing reservoir 316 and the actual color of the in situ mix. The controller 360 adjusts the supply valve members 314 to control the amount of ink being metered out based on the feedback from the colorimetric sensor 354. The controller 360 tracks the level of the in situ mixed ink in the mixing reservoir 316 via the colorimetric sensor 354 and as it is depleted, if required, controls the appropriate supply valve members 314 to replenish the mixing reservoir 316 with the appropriate amounts of ink from the required ink supply dispensers.

In one embodiment of the station 310, after filling an inkjet ink container, the station 310 uses a conventional ink printing channel to print a machine-readable tag (64, 66) identifying the color of the ink filled into the inkjet ink container. The user places the tag (64, 66) on the filled inkjet ink container to identify it during subsequent distribution and use in an inkjet printing system 10, 110, 210. Alternatively, the station 310 may be adapted to automatically place the tag on the filled inkjet ink container as directed by the controller 360.

Preferably, the required amount of ink from each required ink supply dispenser is approximated and metered out for in situ mixing. This minimizes waste of ink and the time required for cleaning and purging the station 310. The purging process described above is also performed after in situ mixing and filling of the desired color in an inkjet ink container. However, if another inkjet ink container is to be filled with the same color, the both purging steps may be skipped. Additionally, if another inkjet ink container is to be filled with a different color, the purging step at the beginning of the in situ mixing and filling process for the next color may be skipped because it would be redundant. Alternate cleaning and purging processes are contemplated. In particular, selection of specific components for valve members, transport tubing, and mixing pumps may require simplified or more complex configurations and process steps to properly accomplish cleaning and purging. For example, in an alternate embodiment, a cleaning fluid may be dispensed and circulated through the station 310 and expelled to the waste collection container to clean and purge the lines.

The described ink mixing station 310 may be used to fill inkjet ink containers with in situ mixtures of basic, primary, or custom colors (depending on the ink supply dispensers available). Alternative uses of station 310 are also possible. For example, the station 310 may be used to fill inkjet ink containers with ink from any individual ink supply dispenser 312 without mixing. One embodiment of the station 310 may include 18 basic and primary color ink supply dispensers with the capacity to install up to four dispensers at one time for mixing over a thousand custom colors.

While the invention is described herein in conjunction with exemplary embodiments, it is evident that many alternatives, modifications, and variations will be apparent to those skilled in the art. Accordingly, the embodiments of the invention in the preceding description are intended to be illustrative, rather than limiting, of the spirit and scope of the invention. More specifically, it is intended that the invention embrace all alternatives, modifications, and variations of the exemplary embodiments described herein that fall within the spirit and scope of the appended claims or the equivalents thereof.

What is claimed is:

1. An inkjet printing system comprising:

multiple premixed ink channels, wherein each premixed ink channel includes a first print head for receiving a premixed ink cartridge with a first machine-readable tag which identifies a color of the ink within the premixed ink cartridge, wherein each premixed ink channel is for printing ink on a target media;

an ink cartridge sensor associated with each premixed ink channel for reading the first machine-readable means on the premixed ink cartridge associated with the premixed ink channel;

an in situ mixed ink channel for receiving two or more premixed ink supply dispensers, wherein each premixed ink supply dispenser includes a second machine-readable tag which identifies the color of ink within the premixed ink supply dispenser, wherein the in situ mixed ink channel is for printing ink on a target media, the in situ mixed ink channel including:

an ink supply dispenser sensor for each premixed ink supply dispenser received by the in situ mixed ink channel;

a supply valve member for each premixed ink supply dispenser received by the in situ mixed ink channel, wherein each supply valve member is in fluidic communication with the associated premixed ink supply dispenser;

a mixing reservoir in fluidic communication with all supply valve members;

a pump motor in fluidic communication with the mixing reservoir; and a second print head in fluidic communication with the pump motor;

a controller in communication with the print heads, the ink cartridge sensors, each ink supply dispenser sensor, each supply valve member, the mixing reservoir, the pump motor, and the second print head for controlling at least a portion of processing associated with printing operations within the inkjet printing system.

2. The inkjet printing system set forth in claim 1, wherein the colors of ink within the premixed ink cartridges include custom colors for printing custom color ink on the target media.

3. The inkjet printing system set forth in claim 1, wherein the inkjet printing system is adapted to operate in an electrophotographic printing system.

4. A method for printing custom colors in an inkjet printing system with multiple ink cartridges, wherein each ink cartridge includes a machine-readable tag which identifies the color of ink within the ink cartridge, wherein two or more of the ink cartridges are installed in the inkjet printing system, comprising the following steps:

a) determining a first desired custom color to be printed;

b) determining a second desired custom color to be printed;

c) reading the machine-readable tag on each of the installed ink cartridges;

d) determining if the ink in any of the installed ink cartridges matches the first desired custom color and, if so, printing in the first desired custom color on a target media;

e) determining if the ink in any of the installed ink cartridges matches the second desired custom color and, if so, printing in the second desired custom color on the target media;

f) if none of the installed ink cartridges contain ink matching the first desired custom color, replacing first installed ink cartridge with a first uninstalled ink cartridge that matches the first desired color to be printed, then printing in the first desired custom color on the target media; and g) if none of the install ink cartridges contain ink matching the second desired custom color, replacing a second installed ink cartridge with an second uninstalled ink cartridge that matches the second desired color to be printed, then printing in the second desired custom color on the target media.

5. An inkjet printing system comprising:

a first in situ mixed ink channel for receiving two or more premixed ink supply dispensers, wherein the premixed ink supply dispensers include a first machine-readable tag which identifies the color of ink within the premixed ink supply dispenser, wherein the first in situ mixed ink channel is for printing ink on a target media, the first in situ mixed ink channel including:

ink supply dispenser sensors for reading the first machine readable tags on the premixed ink supply dispensers received by the first in situ mixed ink channel;

supply valve members for the premixed ink supply dispensers received by the first in situ mixed ink channel, wherein supply valve members are in fluidic communication with the associated premixed ink supply dispensers;

a first mixing reservoir in fluidic communication with the supply valve members;

a first pump motor in fluidic communication with the first mixing reservoir; and a first print head in fluidic communication with the first pump motor; and a controller in communication with the ink supply dispenser sensors and the supply valve members associated with the first in situ mixed ink channel, the first mixing reservoir, the first pump motor, and the first print head for controlling at least a portion of processing associated with printing operations within the printing system.

6. The inkjet printing system set forth in claim 5, wherein the colors of ink within the premixed ink supply dispensers include the basic and primary colors associated with the Pantone® color matching system.

7. The inkjet printing system set forth in claim 5, wherein the colors of ink within the premixed ink supply dispensers include cyan, magenta, yellow, red, green, blue, light magenta, dark magenta, and orange.

8. The inkjet printing system set forth in claim 5, wherein the colors of ink within the premixed ink supply dispensers include constituent primary colors of a standardized color set.

9. The inkjet printing system set forth in claim 5, wherein the colors of ink within the premixed ink supply dispensers include transparent white.

10. The inkjet printing system set forth in claim 5, further comprising:

a second in situ mixed ink channel for receiving two or more of the premixed ink supply dispensers, wherein the second in situ mixed ink channel is for printing ink on a target media, the second in situ mixed ink channel including:

ink supply dispenser sensors for the premixed ink supply dispensers received by the second in situ mixed ink channel;

a supply valve member for the premixed ink supply dispensers received by the second in situ mixed ink channel, wherein the supply valve members are in fluidic communication with the associated premixed ink supply dispenser;

a second mixing reservoir in fluidic communication with the supply valve members;

a second pump motor in fluidic communication with the second mixing reservoir; and a second print head in fluidic communication with the second pump motor; and wherein the controller is also in communication with the ink supply dispenser sensors and the supply valve members associated with the second in situ mixed ink channel, the second mixing reservoir, the second pump motor, and the second print head.

11. The inkjet printing system set forth in claim 5, further comprising:

multiple premixed ink channels, wherein the premixed ink channels include second print heads for receiving a premixed ink cartridge with a second machine-readable tag which identifies the color of ink within the premixed ink cartridge, wherein the premixed ink channels are for printing ink on a target media;

an ink cartridge sensor associated with each premixed ink channel for reading the second machine-readable tag on the premixed ink cartridge associated with the premixed ink channel; and wherein the controller is also in communication with the second print head and the ink cartridge sensor.

12. The inkjet printing system set forth in claim 5, wherein the inkjet printing system is adapted to operate within an electrophotographic printing system.

13. A method for printing custom colors in an inkjet printing system with multiple ink supply dispensers using an in situ mixed ink channel, wherein two or more of the ink supply dispensers are installed in the in situ mixed ink channel, wherein the ink supply dispensers include a machine-readable tag which identifies the color of ink within the ink supply dispenser, comprising the following steps:

a) determining a first desired custom color to be printed;

b) determining which ink supply dispensers are required to create an in situ mixed ink in the first desired custom color;

c) reading the machine-readable tag on each of the installed ink supply dispensers;

d) determining if all the ink supply dispensers required to create an in situ mixed ink in the first desired custom color are installed and, if so, mixing inks from the required ink supply dispensers in an appropriate ratio to create an in situ mixed ink in the first desired custom color and printing in the first desired custom color on a target media; and e) if any of the required ink supply dispensers are not installed, replacing an ink supply dispenser that is not required with a required ink supply dispenser until all of the required ink supply dispensers are installed, then mixing inks from the required ink supply dispensers in an appropriate ratio to create an in situ mixed ink in the first desired custom color and printing in the first desired custom color on a target media.

14. The method set forth in claim 13, further comprising the following step before the mixing activity in steps d) and e):

f) purging supply ink and mixed ink from components of the inkjet printing system associated with transport of multiple supply inks, in situ mixing of supply inks, and transport of in situ mixed ink.

15. The method set forth in claim 13, further comprising the following step associated with the mixing activity in steps d) and e):

f) monitoring an actual color of the in situ mixed ink and, if the actual color does not match the first desired color, adjusting the amount of ink supplied by the required ink supply dispensers until the actual color matches the first desired color.

16. The method set forth in claim 13, further comprising the following steps associated with the mixing and printing activities in steps d) and e):

f) determining an approximate volume of in situ mixed ink required for printing in the first desired color;

g) monitoring a level of in situ mixed ink in a mixing reservoir and, when the approximate volume of in situ mixed ink required is reached or when the ink in the mixing reservoir has reached a first predetermined level, stopping the flow of ink from the required ink supply dispensers to the mixing reservoir;

h) if the in situ mixed ink reaches the first predetermined level in the mixing reservoir before the approximate volume of in situ mixed ink required for printing in the first desired color is mixed, monitoring the level of in situ mixed ink in the mixing reservoir as it is depleted during the printing activity of steps d) or e) and when the level of in situ mixed ink reaches a second predetermined level restarting the flow of ink from the required ink supply dispensers and continuing to mix inks from the required ink supply dispensers in an appropriate ratio to create the in situ mixed ink in the first desired custom color; and i) repeating steps g) and h) until the approximate volume of in situ mixed ink required is reached in step g).

17. The method set forth in claim 13, further comprising the following step after the printing activity in steps d) and e):

f) purging supply ink and mixed ink from components of the inkjet printing system associated with transport of multiple supply inks, in situ mixing of supply inks, and transport of in situ mixed ink.

18. The method set forth in claim 17, further comprising the following steps:

g) determining a second desired custom color to be printed;

h) determining which ink supply dispensers are required to create an in situ mixed ink in the second desired custom color;

i) reading the machine-readable tag on the installed ink supply dispensers;

j) determining if all the ink supply dispensers required to create an in situ mixed ink in the second desired custom color are installed and, if so, mixing inks from the required ink supply dispensers in an appropriate ratio to create an in situ mixed ink in the second desired custom color and printing in the second desired custom color on a target media; and k) if any of the required ink supply dispensers are not installed, replacing an ink supply dispenser that is not required with a required ink supply dispenser until all of the required ink supply dispensers are installed, then mixing inks from the required ink supply dispensers in an appropriate ratio to create an in situ mixed ink in the second desired custom color and printing in the second desired custom color on a target media.

19. An ink mixing station, comprising:

a first in situ mixed ink channel for receiving two or more premixed ink supply dispensers, wherein each premixed ink supply dispenser includes a machine-readable tag which identifies the color of ink within the premixed ink supply dispenser, wherein the first in situ mixed ink channel is for filling ink in inkjet ink containers, the first in situ mixed ink channel including:

an ink supply dispenser sensor for each premixed ink supply dispenser received by the first in situ mixed ink channel;

a supply valve member for each premixed ink supply dispenser received by the first in situ mixed ink channel, wherein each supply valve member is in fluidic communication with the associated premixed ink supply dispenser;

a mixing reservoir in fluidic communication with all supply valve members; and a pump motor in fluidic communication with the mixing reservoir, the pump motor having an interface adapted for installation of the inkjet ink container; and a controller in communication with the ink supply dispenser sensors, the supply valve members, the mixing reservoir, and the pump motor for controlling at least a portion of processing associated with mixing and filling operations within the ink mixing station.

20. The ink mixing station set forth in claim 19, wherein the colors of ink within the premixed ink supply dispensers include the basic and primary colors associated with the Pantone® color matching system.

21. The ink mixing station set forth in claim 19, wherein the inkjet ink container is an inkjet printer ink supply dispenser.

22. The ink mixing station set forth in claim 19, wherein the inkjet ink container is an inkjet printer ink cartridge.

23. A method for mixing custom color inks and filling inkjet ink containers with the custom color ink in an ink mixing station with multiple ink supply dispensers, wherein two or more of the ink supply dispensers are installed in the ink mixing station, wherein each ink supply dispenser includes a machine-readable tag which identifies the color of ink within the ink supply dispenser, comprising the following steps:

a) determining a first desired custom color to be filled in a first inkjet ink container;

b) determining which ink supply dispensers are required to create an in situ mixed ink in the first desired custom color;

c) reading the machine-readable tag on each of the installed ink supply dispensers;

d) determining if all the ink supply dispensers required to create an in situ mixed ink in the first desired custom color are installed and, if so, mixing inks from the required ink supply dispensers in an appropriate ratio to create an in situ mixed ink in the first desired custom color and filling the first inkjet ink container with ink in the first desired custom color; and e) if any of the required ink supply dispensers are not installed, replacing an ink supply dispenser that is not required with a required ink supply dispenser until all of the required ink supply dispensers are installed, then mixing inks from the required ink supply dispensers in an appropriate ratio to create an in situ mixed ink in the first desired custom color and filling the first inkjet ink container with ink in the first desired custom color.

* * * * *